US005416945A

United States Patent [19]

Price

[11] Patent Number: 5,416,945

[45] Date of Patent: May 23, 1995

[54] SPONGE MOP BACKING PLATE AND METHOD OF ATTACHING SCRUBBER STRIP

[75] Inventor: William D. Price, Crystal Springs, Miss.

[73] Assignee: Royal Maid Association for the Blind, Inc., Hazlehurst, Miss.

[21] Appl. No.: 162,877

[22] Filed: Dec. 8, 1993

[51] Int. Cl.[6] ..... A47L 13/12; A47L 13/14

[52] U.S. Cl. ..... 15/118; 15/119.2

[58] Field of Search ..... 15/105, 118, 119.2, 15/244.2

[56] References Cited

U.S. PATENT DOCUMENTS

| | | | |
|---|---|---|---|
| 2,967,317 | 1/1961 | Richards | 15/118 |
| 3,656,202 | 4/1972 | Paton | 15/118 |
| 3,795,933 | 3/1974 | Seufert | 15/244.2 |
| 3,806,982 | 4/1974 | Park | 15/119.2 |
| 4,059,864 | 11/1977 | Spresny | 15/244.2 |
| 4,285,086 | 8/1981 | Wayte | 15/119.2 |
| 4,324,016 | 4/1982 | Herbig | 15/119.2 |
| 4,864,675 | 9/1989 | Jones | 15/119.2 |

FOREIGN PATENT DOCUMENTS

| | | | |
|---|---|---|---|
| 0164716 | 2/1954 | Australia | 15/244.1 |
| 747268 | 3/1956 | United Kingdom | 15/118 |

*Primary Examiner*—David A. Scherbel
*Assistant Examiner*—Randall E. Chin

[57] ABSTRACT

A sponge mop that comprises a backing plate upon which both a sponge and a scrubber strip have been mounted so as to expose an edge of said backing plate for use as a cleaning tool. Said backing plate may be heated and thereafter said sponge may be heat fused to said backing plate and said scrubber strip may be heat fused to said backing plate in perpendicular fashion to said sponge so as to expose an edge of said backing plate for use as a cleaning tool.

13 Claims, 2 Drawing Sheets

SPONGE MOP BACKING PLATE AND METHOD OF ATTACHING SCRUBBER STRIP

FIELD OF THE INVENTION

The invention relates to a sponge mop that usually comprises a wooden handle attached to a metal or plastic plate assembly which carries a rectangular sponge of greater length than width that is designed to absorb water and detergent, mop a floor by manual back and forth motion, and release the resulting dirty water when squeezed by the plate assembly. Such sponge mops are relatively inexpensive, and generally available through supermarkets, hardware stores and drug store chains.

BACKGROUND OF THE INVENTION

The metal or plastic plate assembly of such a sponge mop generally squeezes the sponge carried by that assembly in one of two ways, either longitudinally along the length of the sponge, often by rollers or a squeeze plate, or perpendicularly to the length of the sponge, in the fashion know in the industry as a butterfly assembly. The present invention is an improvement to the former type of sponge mop assembly.

Some previous improvements to the former type of sponge mop assembly have concentrated upon the means and methods of attaching a sponge to the metal or plastic plate assembly. While a sponge is the central cleaning tool mounted on such an assembly, it is neither strong enough nor abrasive enough to remove hard, stubborn material from some floors.

Other previous improvements have added a separate tool, such as a scrubber strip, which is made out of a material that is stronger and more abrasive than a sponge, to the plate assembly. For example, a scrubber strip has been mounted on the sponge that is attached to a plate assembly, which affords only soft support for the scrubber strip and, to the extent that sponge support is resilient, allows the scrubber strip to recoil from and slide over hard, stubborn material that is stuck to a floor.

Previously, such a scrubber strip has been attached to the sponge by glue, which results in variable positioning of the scrubber strip in relation to the sponge. The scrubber strip tends to move and reposition itself while, the glue is drying, causing inaccuracies in the product line of sponge mops.

SUMMARY OF THE INVENTION

It is an object of the present invention to provide a backing plate for both a sponge and a scrubber strip that can be easily attached to and detached from a plate assembly that is designed to be mounted on a sponge mop handle.

It is a further object of the present invention to provide such a backing plate upon which both a sponge and scrubber strip can be mounted and affixed sequentially or simultaneously to form a unit that is strong enough to effectively clean hard, stubborn material from floors.

It is a further object of the present invention to provide such a backing plate upon which both a sponge and scrubber strip can be mounted and affixed to form a unit which exposes an edge of the backing plate material that can be used to clean hard, stubborn material from floors.

It is a still further object of the present invention to provide a method for mounting and affixing by heat fusion, either sequentially or simultaneously, both a sponge and scrubber strip to a backing plate so as to form a unit that is both accurate as to its positioning and strong enough to effectively clean hard, stubborn material from floors.

And, it is a further object of the present invention to provide a method for mounting and affixing, either sequentially or simultaneously, both a sponge and scrubber strip to such a backing plate so as to form a unit which affords cleaning of floors and the like by the sponge, the scrubber strip and at least one exposed edge of the backing plate.

Mounting a scrubber strip on the backing plate provides a much stronger support for the scrubber strip, allowing it to relay much greater contact pressure from the mop handle to the hard, stubborn material to be removed from a floor or the like. And, fusing both the sponge and scrubber plate to the backing plate provides a stronger attachment and improves the accuracy of positioning these tools in relation to the backing plate.

By providing a subsidiary portion of the backing plate molded substantially perpendicular to the main portion of the backing plate, the former to support the scrubber strip and the latter to support the sponge, the entire backing plate is strengthened, virtually eliminating warping of the backing plate. And, providing at least one exposed edge of the backing plate adjacent the scrubber strip affords an even stronger scraping tool for removing such material.

DETAILED DESCRIPTION OF THE INVENTION

Figure 1:
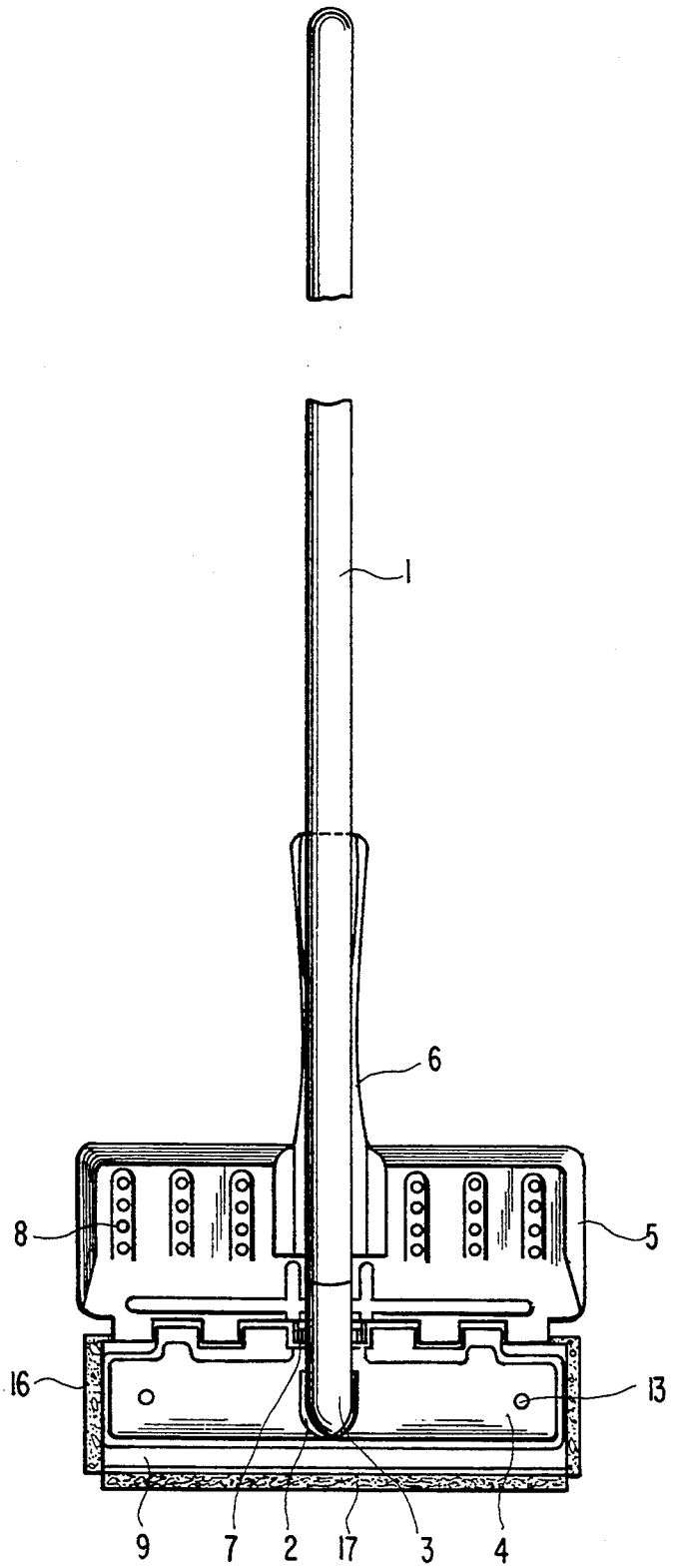
FIG. 1 is a plan view of a sponge mop of the type that includes a sponge that is designed to be squeezed along the length of that sponge by a squeeze plate.

As shown in FIG. 1, a sponge mop of the type that includes a sponge that is designed to be squeezed along its length may comprise a handle 1 attached to a squeeze plate assembly 2. The squeeze plate assembly 2 includes a circular sleeve 3 into which handle 1 is inserted and attached by crimping sleeve 3 into the wood of handle 1, or by insertion of a nail, screw or other such means through sleeve 3 into handle 1.

Mounting plate 4 may be attached to circular sleeve 3 at an appropriately comfortable angle, such as 45 degrees, by any satisfactory means or preferably they may be fabricated together as a unit. Squeeze plate 5 may be attached to mounting plate 4 by a hinge, and may be manipulated by squeeze plate handle 6 attached thereto. Squeeze plate handle 6 may be attached to squeeze plate 5 by any satisfactory means or preferably they may be fabricated together as a unit.

As shown in FIG. 1, squeeze plate 5 is held against handle 1 by spring 7, which may be compressed by gripping squeeze plate handle 6 and rotating squeeze plate 5 toward mounting plate 4 along its length.

Squeeze plate 5 may be provided with holes 8 through which water may be squeezed.

Backing plate 9 is shown in FIG. 1 and in greater detail in FIGS. 2 through 5. Backing plate 9 includes a sponge mounting seat 10 through which slots 11 may be cut or punched. Attachment nipples 12 may be affixed to backing plate 9 opposite sponge mounting seat 10. Attachment nipples 12 may be provided in any appropriate size or shape so long as they mate: with holes 13 provided in mounting plate 4 and hold backing plate 9 firmly against mounting plate 4 during use of the sponge mop. Preferably, sponge mounting seat 10 may be fabricated together with backing plate 9 and attachment nipples 12 as a unit. Such a unit may be made of relatively hard plastic, or any other suitable material.

Figure 2:
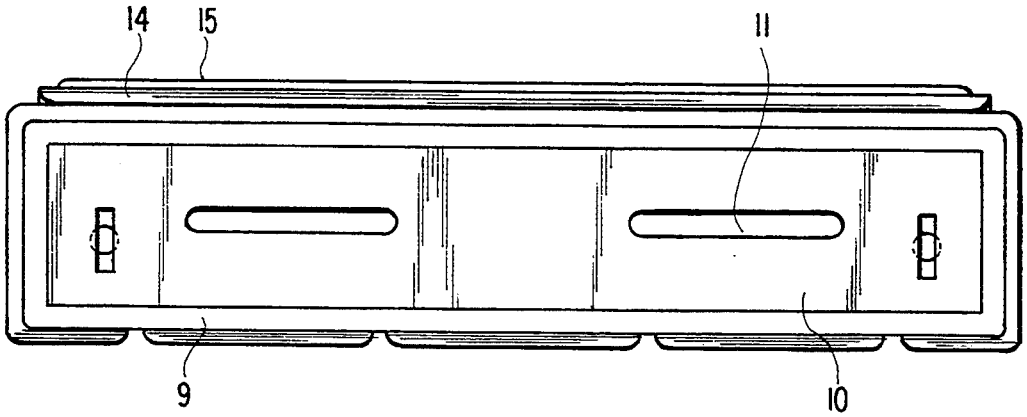
FIG. 2 is a plan view of a backing plate for that sponge mop.
Figure 3:
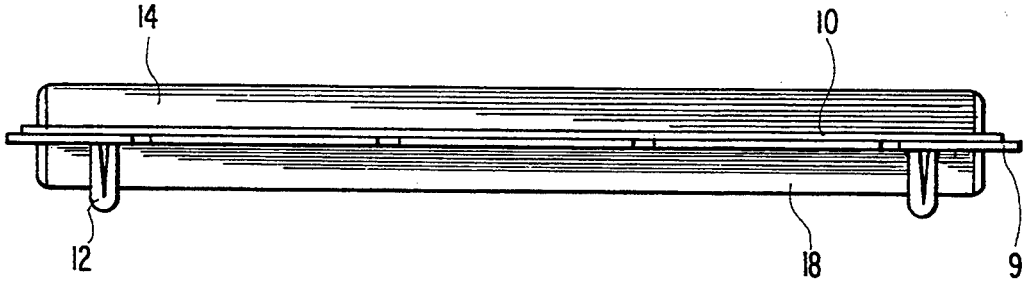
FIG. 3 is an elevation view of a backing plate for that sponge mop.
Figure 4:
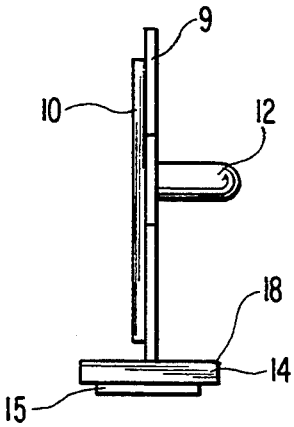
FIG. 4 is a side view of a backing plate for that sponge mop.

Backing plate 9 is relatively thin and rectangular in shape and planar, and is provided with backing plate member 14 affixed along one of the backing plate's longer peripheral sides. Backing plate member 14 is affixed in substantially perpendicular fashion to backing plate 9 and extends above and below the plane of the backing plate 9, and includes scrubber strip mounting seat 15 affixed substantially along its length as shown in FIG. 2. Backing plate member 14 and scrubber strip mounting seat 15 may be affixed to backing plate 9 in any suitable way, but the preferred way is to fabricate them together as a unit as shown in FIG. 4. The well known method of plastic molding is a satisfactory method of fabricating them together as a unit.

Figure 5:
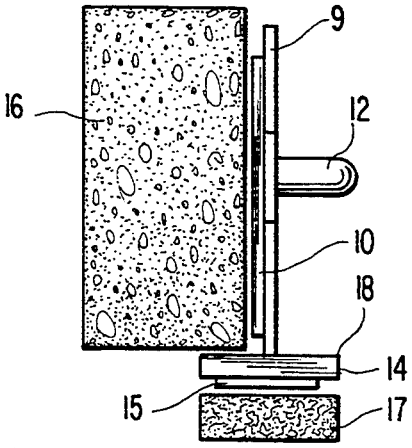
FIG. 5 is a side view of a backing plate for that sponge mop shown together with a sponge and a scrubber strip in position to be affixed to that backing plate.

As shown in FIG. 5, a sponge 16 may be mounted onto sponge mounting seat 10, and a scrubber strip 17 may be mounted onto scrubber strip mounting seat 15. Such mounting may be accomplished by use of any satisfactory adhesive, but preferably may be accomplished by heat fusing sponge 16 to sponge mounting seat 10 and by heat fusing scrubber strip 17 to scrubber strip mounting seat 15.

The preferred method for fusing sponge 16 to sponge mounting seat 10 and fusing scrubber strip 17 to scrubber strip mounting seat 15 comprises applying heat to backing plate 9 opposite sponge mounting seat 10 and to backing plate member 14 opposite scrubber strip mounting seat 14, pressing sponge 16 to the heated sponge mounting seat 10, and pressing scrubber strip 17 to the heated scrubber strip mounting seat 15.

Such heat may be provided by a single heat block made of heat conducting metal, or other suitable material, that has at least one square corner the edges of which may be positioned simultaneously along backing plate 9 opposite sponge mounting seat 10 and along backing plate member 14 opposite scrubber strip mounting seat 15. The heat provided by such a heat block may be conducted through backing plate 9 and backing plate member 14, respectively, into sponge mounting seat 10 and scrubber strip mounting seat 15, respectively, raising the temperature of said seats to the point at which heat fusing can take place.

Sponge 16 may be fused to sponge mounting seat 10 sequentially before or after the fusing of scrubber strip 17 to scrubber strip mounting seat 15, or they may be fused simultaneously. If the backing plate and its component parts are made of relatively hard plastic, the fusing of both the sponge material and the scrubber strip material to their respective pads takes place quickly, almost instantaneously after being pressed against each respective heated seat.

A backing plate 9 that is provided with mounting seat 10 and scrubber strip mounting seat 15 as shown in FIGS. 1 through 5 also provides edge 18 of backing plate member 14 that may be used to scrape hard, stubborn material from a floor or the like. A sponge mop made as described: provides at least three tools for removing material from floors and the like, a sponge, a scrubber strip and an edge of the backing plate to which the sponge and scrubber strip is attached.

Although I have described only the best means and method for practicing my invention, other equivalents should be understood to be embraced within the scope of the following claims.

I claim:

1. A substantially rectangular and planar backing plate having peripheral edges for mounting onto a plate assembly of a sponge mop, which comprises a substantially rectangular backing plate member integral with and substantially perpendicular to said backing plate along one of said backing plate's longer peripheral edges, said backing plate member extending above and below the plane of said backing plate, a sponge affixed to said backing plate, and a scrubber strip affixed to said backing plate member.

2. A backing plate as described in claim 1 on which said sponge and said scrubber strip are affixed in positions substantially perpendicular to each other.

3. A backing plate as described in claim 1 which comprises a substantially rectangular sponge mounting seat and a substantially rectangular scrubber strip mounting seat, said scrubber strip mounting seat affixed to said backing plate member in a position that is substantially perpendicular to said sponge mounting seat.

4. A backing plate as described in claim 1 on which said sponge and said scrubber strip are affixed in positions substantially perpendicular to each other so as to expose at least one edge of said backing plate member for use as a cleaning tool.

5. A substantially rectangular and planar backing plate having peripheral edges for mounting onto a plate assembly of a sponge mop, which comprises a substantially rectangular backing plate member integral with and substantially perpendicular to said backing plate along one of said backing plate's longer peripheral edges, said backing plate member extending above and below the plane of said backing plate, a sponge fused by heat to said backing plate, and a scrubber strip fused by heat to said backing plate member.

6. A backing plate as described in claim 5 on which said sponge and said scrubber strip are fused in positions substantially perpendicular to each other.

7. A sponge mop that includes a plate assembly upon which a substantially rectangular and planar backing plate having peripheral edges is mounted, said backing plate comprising a substantially rectangular backing plate member integral with and substantially perpendicular to said backing plate along one of said backing plate's longer peripheral edges, said backing plate member extending above and below the plane of said backing plate, a sponge mounting seat affixed to said backing plate and a scrubber strip mounting seat affixed to said backing plate member, a sponge affixed to said sponge mounting seat, and a scrubber strip affixed to said scrubber strip mounting seat.

8. A sponge mop as described in claim 7 upon which said sponge affixed to said backing plate and said scrubber strip affixed to said backing plate member are affixed in positions substantially perpendicular to each other.

9. A sponge mop as described in claim 7 wherein said scrubber strip mounting seat and said sponge mounting seat are affixed in a position substantially perpendicular to each other.

10. A sponge mop that includes a plate assembly upon which a substantially rectangular and planar backing plate having peripheral edges is mounted, said backing plate comprising a substantially rectangular backing plate member integral with and substantially perpendicular to said backing plate along one of said backing plate's longer peripheral edges, said backing plate member extending above and below the plane of said backing plate, a sponge mounting seat affixed to said backing plate and a scrubber strip mounting seat affixed to said backing plate member, a sponge fused by heat to said sponge mounting seat, and a scrubber strip fused by heat to said scrubber strip mounting seat.

11. A sponge mop as described in claim 10 upon which said sponge fused to said backing plate and said scrubber strip fused to said backing plate member are fused in positions substantially perpendicular to each other.

12. A sponge mop as described in claim 10 wherein said scrubber strip mounting seat and said sponge mounting seat are affixed in a position substantially perpendicular to each other.

13. A sponge mop that includes a plate assembly upon which a substantially rectangular and planar backing plate having peripheral edges is mounted, said backing plate comprising a substantially rectangular backing plate member integral with and substantially perpendicular to said backing plate along one of said backing plate's longer peripheral edges, said backing plate member extending above and below the plane of said backing plate, a sponge mounting seat affixed to said backing plate and a scrubber strip mounting seat affixed to said backing plate member in a position substantially perpendicular to said sponge mounting seat so as to expose at least one edge of said backing plate member for use as a cleaning tool.

* * * * *